US012507726B2

(12) United States Patent
Park

(10) Patent No.: US 12,507,726 B2
(45) Date of Patent: Dec. 30, 2025

(54) ARTICLE AND SYSTEM FOR GENERATING AEROSOL

(71) Applicant: KT&G CORPORATION, Daejeon (KR)

(72) Inventor: In Su Park, Seoul (KR)

(73) Assignee: KT&G CORPORATION, Daejeon (KR)

( * ) Notice: Subject to any disclaimer, the term of this patent is extended or adjusted under 35 U.S.C. 154(b) by 818 days.

(21) Appl. No.: 17/432,356

(22) PCT Filed: Apr. 7, 2021

(86) PCT No.: PCT/KR2021/004366
§ 371 (c)(1),
(2) Date: Aug. 19, 2021

(87) PCT Pub. No.: WO2021/225291
PCT Pub. Date: Nov. 11, 2021

(65) Prior Publication Data

US 2023/0133325 A1 May 4, 2023

(30) Foreign Application Priority Data

May 7, 2020 (KR) ..... 10-2020-0054768

(51) Int. Cl.
*A24D 1/20* (2020.01)
*A24B 15/167* (2020.01)
(Continued)

(52) U.S. Cl.
CPC ..... *A24D 1/20* (2020.01); *A24B 15/167* (2016.11); *A24D 1/002* (2013.01); *A24D 1/04* (2013.01);
(Continued)

(58) Field of Classification Search
CPC . A24D 1/20; A24D 3/17; A24D 1/002; A24D 1/04; A24B 15/167; A24F 40/46; A24F 40/20
See application file for complete search history.

(56) References Cited

U.S. PATENT DOCUMENTS 5,499,636 A * 3/1996 Baggett, Jr. ..... A24C 5/01 131/194
11,272,731 B2 3/2022 Zuber et al.
(Continued)

FOREIGN PATENT DOCUMENTS

CN 102355914 A 2/2012
CN 104039183 A 9/2014
(Continued)

OTHER PUBLICATIONS

US 11,503,856 B2, 11/2022, Zuber et al. (withdrawn)
(Continued)

*Primary Examiner* — Linda L Gray
(74) *Attorney, Agent, or Firm* — Sughrue Mion, PLLC

(57) ABSTRACT

An aerosol generating article includes: a first segment arranged at an upstream end portion to be inserted into the aerosol generating device; a second segment arranged at a downstream end portion to contact a user's mouth; and a third segment arranged between the first segment and the second segment, and comprising a cooling element, wherein the first segment comprises: a first filter portion; a second filter portion; and a medium portion arranged between the first filter portion and the second filter portion, comprising an aerosol generating substrate and a pH adjuster such that an aerosol containing 20 μg or more of nicotine is discharged per puff when the medium portion is heated at a temperature of 120° C. or lower.

9 Claims, 3 Drawing Sheets

(51) Int. Cl.

| | |
|---|---|
| ***A24D 1/00*** | (2020.01) |
| ***A24D 1/04*** | (2006.01) |
| ***A24D 3/17*** | (2020.01) |
| ***A24F 40/20*** | (2020.01) |
| ***A24F 40/46*** | (2020.01) |

(52) U.S. Cl.
CPC ..... *A24D 3/17* (2020.01); *A24F 40/20* (2020.01); *A24F 40/46* (2020.01)

(56) References Cited

U.S. PATENT DOCUMENTS

| | | | | |
|---|---|---|---|---|
| 2008/0087290 | A1 | 4/2008 | Taniguchi et al. | |
| 2011/0180082 | A1* | 7/2011 | Banerjee | A24D 1/002 131/194 |
| 2012/0006342 | A1 | 1/2012 | Rose et al. | |
| 2014/0305449 | A1* | 10/2014 | Plojoux | A24F 40/46 131/328 |
| 2014/0345634 | A1 | 11/2014 | Zuber et al. | |
| 2018/0235278 | A1 | 8/2018 | Mahler et al. | |
| 2020/0029616 | A1 | 1/2020 | Uthurry | |
| 2020/0113227 | A1 | 4/2020 | Mclaughlin et al. | |
| 2020/0163377 | A1 | 5/2020 | Franke et al. | |
| 2020/0205467 | A1 | 7/2020 | Liu et al. | |
| 2020/0359696 | A1 | 11/2020 | Lim | |

FOREIGN PATENT DOCUMENTS

| | | | |
|---|---|---|---|
| CN | 108065456 | A | 5/2018 |
| CN | 110636761 | A | 12/2019 |
| CN | 110891434 | A | 3/2020 |
| CN | 110913709 | A | 3/2020 |
| EP | 1 856 991 | A1 | 11/2007 |
| EP | 3 632 231 | A1 | 4/2020 |
| JP | 2015-503337 | A | 2/2015 |
| KR | 10-2016-0035098 | A | 3/2016 |
| KR | 10-2018-0069049 | A | 6/2018 |
| KR | 10-2019-0049135 | A | 5/2019 |
| KR | 10-2019-0049628 | A | 5/2019 |
| WO | 2013/011899 | A1 | 1/2013 |

OTHER PUBLICATIONS

English machine translation of CN104039183 A; Zuber: Sep. 2014; 24 pages. (Year: 2014).*

English machine translation of CN110913709 A; Frank D; Mar. 2020; 19 pages. (Year: 2020).*

English Machine translation of KR20190049135A; Sook et al.; May 9, 2019; 21 pages. (Year: 2019).*

How to Calculate; 2 pages; Sep. 24, 2018. (Year: 2018).*

Communication dated Sep. 28, 2023 issued by the State Intellectual Property Office of the P.R.China in application No. 202180003360.5.

Office Action issued Apr. 26, 2023 in Chinese Application No. 202180003360.5.

International Search Report for PCT/KR2021/004366 dated Jul. 19, 2021 [PCT/ISA/210].

Written Opinion for PCT/KR2021/004366 dated Jul. 19, 2021 [PCT/ISA/237].

Japanese Office Action dated Nov. 29, 2022 in Japanese Application No. 2021-556895.

Korean Office Action dated May 29, 2024 in Application No. 10-2023-0079268.

* cited by examiner

ARTICLE AND SYSTEM FOR GENERATING AEROSOL

CROSS REFERENCE TO RELATED APPLICATIONS

This application is a National Stage of International Application No. PCT/KR2021/004366 filed Apr. 7, 2021, claiming priority based on Korean Patent Application No. 10-2020-0054768 filed May 7, 2020.

TECHNICAL FIELD

One or more embodiments of the present disclosure relate to an aerosol generating article and a system thereof.

BACKGROUND ART

Recently, the demand for an alternative to traditional combustive cigarettes has increased. For example, there is growing demand for an aerosol generating device which generates an aerosol by heating an aerosol generating material, instead of combusting aerosol generating materials. Accordingly, researches on a heating-type aerosol generating articles or heating-type aerosol generating device has been actively conducted.

In addition, there is a need for an aerosol generating article that is hygienic and capable of continuously and uniformly discharging nicotine even when heated to a low temperature.

DISCLOSURE OF INVENTION

Technical Problem

One or more embodiments of the present disclosure provide an aerosol generating article capable of continuously and uniformly discharging nicotine even when heated to a low temperature.

Additional aspects will be set forth in part in the description which follows and, in part, will be apparent from the description, or may be learned by the practice of the presented embodiments.

Solution to Problem

According to one aspect of the present disclosure, an aerosol generating article includes: a first segment arranged at an upstream end portion to be inserted into an aerosol generating device; a second segment arranged at a downstream end portion to contact a user's mouth; and a third segment arranged between the first segment and the second segment, and including a cooling element to cool an aerosol, wherein the first segment may include a first filter portion; a second filter portion; and a medium portion arranged between the first filter portion and the second filter portion, and comprising an aerosol generating substrate and a pH adjuster such that an aerosol containing 20 μg or more of nicotine is discharged per puff when the medium portion is heated at 120° C. or lower.

According to another aspect of the present disclosure, an aerosol generating system includes: an aerosol generating article; and an aerosol generating device into which the aerosol generating article is inserted, wherein the aerosol generating device may include a battery and a heater heated by power supplied from the battery, and the aerosol generating article may include: a first segment arranged at an upstream end portion to be inserted into the aerosol generating device; a second segment arranged at a downstream end portion to contact a user's mouth; and a third segment arranged between the first segment and the second segment, and including a cooling element to cool an aerosol, wherein the first segment may include: a first filter portion; a second filter portion; and a medium portion arranged between the first filter portion and the second filter portion, comprising an aerosol generating substrate and a pH adjuster such that an aerosol containing 20 μg or more of nicotine is discharged per puff when the medium portion is heated at a temperature of 120° C. or lower.

Advantageous Effects of Invention

According to one or more embodiments of the present disclosure, the medium portion may be prevented from falling off by arranging the medium portion including the pH adjuster between the two filter portions. Since the aerosol generating article is made for a single use, it may enhance hygiene. Even if the aerosol generating article is heated at a low temperature, it may be possible to achieve sustained, uniform, and adequate nicotine transfer. In addition, according to one or more embodiments of the present disclosure, when the aerosol generating article is inserted into the aerosol generating device, a heater may be arranged to surround the medium portion, thereby increasing the efficiency of heat transfer and reducing power consumption.

Embodiments of the present disclosure are not limited thereto. It is to be appreciated that the scope of the disclosure should be defined by the appended claims.

BEST MODE FOR CARRYING OUT THE INVENTION

Figure 1:
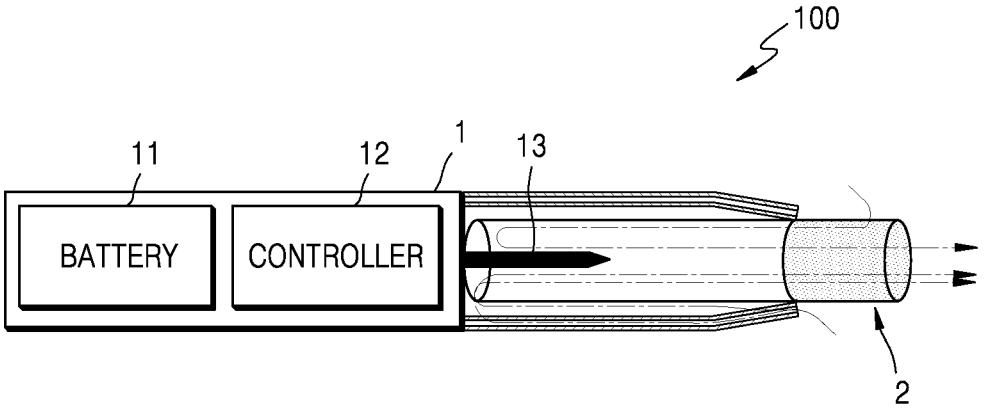
FIGS. 1 through 3 are diagrams showing examples in which a cigarette is inserted into an aerosol generating device.

According to one aspect of the present disclosure, an aerosol generating article includes: a first segment arranged at an upstream end portion to be inserted into an aerosol generating device; a second segment arranged at a downstream end portion to contact a user's mouth; and a third segment arranged between the first segment and the second segment, and including a cooling element to cool an aerosol, wherein the first segment may include: a first filter portion; a second filter portion; and a medium portion arranged between the first filter portion and the second filter portion, and comprising an aerosol generating substrate and a pH adjuster such that an aerosol containing 20 μg or more of nicotine is discharged per puff when the medium portion is heated at 120° C. or lower.

The first filter portion, the medium portion, and the second filter portion may be surrounded by a single wrapper.

The pH adjuster may include potassium carbonate ($K_2CO_3$).

The medium portion may further include a binder, and the binder may include at least one of hydroxypropyl methylcellulose and gum.

Lengths of the first filter portion, the medium portion, and the second filter portion may be in a range of 5 mm to 10 mm.

A weight of the medium portion may be in a range of 70 mg to 120 mg.

The aerosol generating substrate of the medium portion may include nicotine, and a weight of nicotine contained in the aerosol discharged from the medium portion after heating may be 10% to 30% of a weight of nicotine in the medium portion before heating.

When the medium portion is heated at a temperature of 120° C. or lower, an aerosol containing 20 μg to 40 μg of nicotine per puff may be discharged during at least 10 consecutive puffs.

According to another aspect of the present disclosure, an aerosol generating system includes: an aerosol generating article; and an aerosol generating device into which the aerosol generating article is inserted, wherein the aerosol generating device may include a battery and a heater heated by power supplied from the battery, and the aerosol generating article may include: a first segment arranged at an upstream end portion to be inserted into the aerosol generating device; a second segment arranged at a downstream end portion to contact a user's mouth; and a third segment arranged between the first segment and the second segment, and including a cooling element to cool an aerosol, wherein the first segment may include: a first filter portion; a second filter portion; and a medium portion arranged between the first filter portion and the second filter portion, comprising an aerosol generating substrate and a pH adjuster such that an aerosol containing 20 μg or more of nicotine is discharged per puff when the medium portion is heated at a temperature of 120° C. or lower.

When the aerosol generating article is inserted into the aerosol generating device, the heater may be arranged to surround at least a portion of an outer surface of the medium portion.

MODE FOR THE INVENTION

With respect to the terms used to describe the various embodiments, general terms which are currently and widely used are selected in consideration of functions of structural elements in the various embodiments of the present disclosure. However, meanings of the terms can be changed according to intention, a judicial precedence, the appearance of new technology, and the like. In addition, in certain cases, a term which is not commonly used can be selected. In such a case, the meaning of the term will be described in detail at the corresponding portion in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements. Expressions such as "at least one of," when preceding a list of elements, modify the entire list of elements and do not modify the individual elements of the list. For example, the expression, "at least one of a, b, and c," should be understood as including only a, only b, only c, both a and b, both a and c, both b and c, or all of a, b, and c.

It will be understood that when an element or layer is referred to as being "over," "above," "on," "connected to" or "coupled to" another element or layer, it can be directly over, above, on, connected or coupled to the other element or layer or intervening elements or layers may be present. In contrast, when an element is referred to as being "directly over," "directly above," "directly on," "directly connected to" or "directly coupled to" another element or layer, there are no intervening elements or layers present. Like numerals refer to like elements throughout.

The term "aerosol generating article" may refer to an article containing an aerosol generating material, which is combined with an aerosol generating device. The shape, size, material, and structure of the aerosol generating article may differ according to embodiments. Examples of the aerosol generating article may include, but are not limited to, a cigarette-shaped substrate (hereinafter "cigarette") and a cartridge.

As used herein, terms including an ordinal number such as "first" or "second" may be used to describe various components, but the components should not be limited by the terms. The terms may be used for the purpose of distinguishing one component from other components.

In the following embodiments, terms "upstream" and "downstream" refer to a relative position or direction between segments that make up an aerosol generating article. When a user inhales air on a smoking article, air flows in a downstream direction. In other words, a portion where air enters the aerosol generating article from the outside is "upstream" and a portion where air goes out of the aerosol generating article is "downstream".

Hereinafter, the present disclosure will now be described more fully with reference to the accompanying drawings, in which exemplary embodiments of the present disclosure are shown such that one of ordinary skill in the art may easily work the present disclosure. The disclosure may, however, be embodied in many different forms and should not be construed as being limited to the embodiments set forth herein.

Hereinafter, embodiments of the present disclosure will be described in detail with reference to the drawings.

Figure 2:
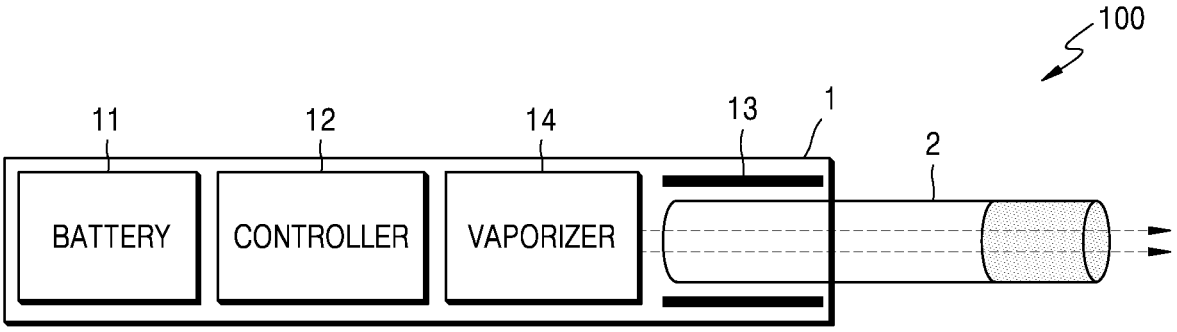
Figure 3:
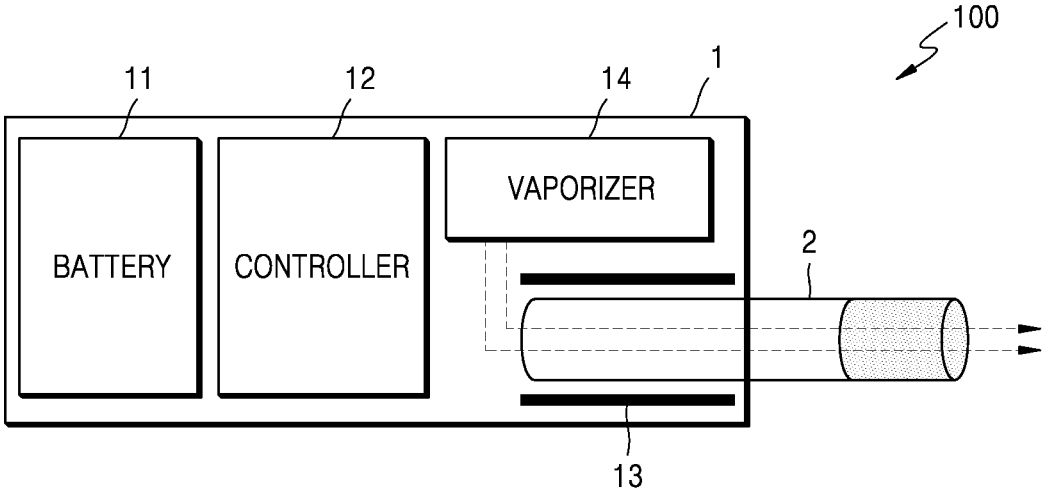

FIGS. 1 through 3 are diagrams showing examples in which a cigarette is inserted into an aerosol generating device.

Referring to FIG. 1 through 3, the aerosol generating system 100 may include aerosol generating device 1 and aerosol generating article 2 inserted the aerosol generating device 1.

The aerosol generating device 1 may include a battery 11, a controller 12, and a heater 13. Referring to FIGS. 2 and 3, the aerosol generating device 1 may further include a vaporizer 14. Also, the aerosol generating article 2 may be inserted into an inner space of the aerosol generating device 1.

FIGS. 1 through 3 illustrate components of the aerosol generating device 1, which are related to the present embodiment. Therefore, it will be understood by one of ordinary skill in the art related to the present embodiment that other general-purpose components may be further included in the aerosol generating device 1, in addition to the components illustrated in FIGS. 1 through 3.

FIG. 1 illustrates that the battery 11, the controller 12, and the heater 13 are arranged in series. Also, FIG. 2 illustrates that the battery 11, the controller 12, the vaporizer 14, and the heater 13 are arranged in series. Also, FIG. 3 illustrates that the vaporizer 14 and the heater 13 are arranged in parallel. However, the internal structure of the aerosol generating device 1 is not limited to the structures illustrated in FIGS. 1 through 3. In other words, according to the design of the aerosol generating device 1, the battery 11, the controller 12, the heater 13, and the vaporizer 14 may be differently arranged.

When the aerosol generating article 2 is inserted into the aerosol generating device 1, the aerosol generating device 1 may operate the heater 13 and/or the vaporizer 14 to generate aerosol from the aerosol generating article 2 and/or the vaporizer 14. The aerosol generated by the heater 13 and/or the vaporizer 14 is delivered to a user by passing through the aerosol generating article 2.

As necessary, even when the aerosol generating article 2 is not inserted into the aerosol generating device 1, the aerosol generating device 1 may heat the heater 13.

The battery 11 may supply power to be used for the aerosol generating device 1 to operate. For example, the battery 11 may supply power to heat the heater 13 or the vaporizer 14, and may supply power for operating the controller 12. Also, the battery 11 may supply power for operations of a display, a sensor, a motor, etc. mounted in the aerosol generating device 1.

The controller 12 may generally control operations of the aerosol generating device 1. In detail, the controller 12 may control not only operations of the battery 11, the heater 13, and the vaporizer 14, but also operations of other components included in the aerosol generating device 1. Also, the controller 12 may check a state of each of the components of the aerosol generating device 1 to determine whether or not the aerosol generating device 1 is able to operate.

The controller 12 may include at least one processor. A processor can be implemented as an array of a plurality of logic gates or can be implemented as a combination of a general-purpose microprocessor and a memory in which a program executable in the microprocessor is stored. It will be understood by one of ordinary skill in the art that the processor can be implemented in other forms of hardware.

The heater 13 may be heated by the power supplied from the battery 11. For example, when the aerosol generating article 2 is inserted into the aerosol generating device 1, the heater 13 may be located outside the aerosol generating article 2. Thus, the heated heater 13 may increase a temperature of an aerosol generating material in the aerosol generating article 2.

The heater 13 may include an electro-resistive heater. For example, the heater 13 may include an electrically conductive track, and the heater 13 may be heated when currents flow through the electrically conductive track. However, the heater 13 is not limited to the example described above and may include all heaters which may be heated to a desired temperature. Here, the desired temperature may be pre-set in the aerosol generating device 1 or may be set by a user.

The heater 13 may include a cylindrical-type heating element, a tube-type heating element, a plate-type heating element, a needle-type heating element, or a rod-type heating element, and may heat the inside or the outside of the aerosol generating article 2, according to the shape of the heating element.

Also, the aerosol generating device 1 may include a plurality of heaters 13. Here, the plurality of heaters 13 may be inserted into the aerosol generating article 2 or may be arranged outside the aerosol generating article 2. Also, some of the plurality of heaters 13 may be inserted into the aerosol generating article 2 and the others may be arranged outside the aerosol generating article 2. In addition, the shape of the heater 13 is not limited to the shapes illustrated in FIGS. 1 through 3 and may include various shapes.

The vaporizer 14 may generate aerosol by heating a liquid composition and the generated aerosol may pass through the aerosol generating article 2 to be delivered to a user. In other words, the aerosol generated via the vaporizer 14 may move along an air flow passage of the aerosol generating device 1 and the air flow passage may be configured such that the aerosol generated via the vaporizer 14 passes through the aerosol generating article 2 to be delivered to the user.

For example, the vaporizer 14 may include a liquid storage, a liquid delivery element, and a heating element, but it is not limited thereto. For example, the liquid storage, the liquid delivery element, and the heating element may be included in the aerosol generating device 1 as independent modules.

The liquid storage may store a liquid composition. For example, the liquid composition may be a liquid including a tobacco-containing material having a volatile tobacco flavor component, or a liquid including a non-tobacco material. The liquid storage may be formed to be detachable from the vaporizer 14 or may be formed integrally with the vaporizer 14.

For example, the liquid composition may include water, a solvent, ethanol, plant extract, spices, flavorings, or a vitamin mixture. The spices may include menthol, peppermint, spearmint oil, and various fruit-flavored ingredients, but are not limited thereto. The flavorings may include ingredients capable of providing various flavors or tastes to a user. Vitamin mixtures may be a mixture of at least one of vitamin A, vitamin B, vitamin C, and vitamin E, but are not limited thereto. Also, the liquid composition may include an aerosol forming substance, such as glycerin and propylene glycol.

The liquid delivery element may deliver the liquid composition of the liquid storage to the heating element. For example, the liquid delivery element may be a wick such as cotton fiber, ceramic fiber, glass fiber, or porous ceramic, but is not limited thereto.

The heating element is an element for heating the liquid composition delivered by the liquid delivery element. For example, the heating element may be a metal heating wire, a metal hot plate, a ceramic heater, or the like, but is not limited thereto. In addition, the heating element may include a conductive filament such as nichrome wire and may be positioned as being wound around the liquid delivery element. The heating element may be heated by a current supply and may transfer heat to the liquid composition in contact with the heating element, thereby heating the liquid composition. As a result, the aerosol may be generated.

For example, the vaporizer 14 may be referred to as a cartomizer or an atomizer, but it is not limited thereto.

The aerosol generating device 1 may further include general-purpose components in addition to the battery 11, the controller 12, the heater 13, and the vaporizer 14. For example, the aerosol generating device 1 may include a display capable of outputting visual information and/or a motor for outputting haptic information. Also, the aerosol generating device 1 may include at least one sensor. Also, the aerosol generating device 1 may be formed as a structure that, even when the aerosol generating article 2 is inserted into the aerosol generating device 1, may introduce external air or discharge internal air.

The aerosol generating article 2 may be divided into a first segment including an aerosol generating material, a second segment including a filter or the like, and a third segment including a cooling element. Alternatively, the first segment of the aerosol generating article 2 may include a filter or the like.

The first segment may be completely inserted into the aerosol generating device 1, and the third segment and the second segment may be partially exposed to the outside.

Alternatively, the first segment may be partially inserted into the aerosol generating device 1, or the entire first segment and a portion of the third segment may be inserted into the aerosol generating device 1. A user may inhale while holding the second segment by the mouth of the user. In that case, the aerosol is generated when air from the outside passes through the first segment, and the generated aerosol is delivered to the user's mouth through the third segment and the second segment.

As an example, air may flow in from the outside through at least one air passage formed within the aerosol generating device 1. For example, opening and closing of the air passage formed within the aerosol generating device 1 and/or a size of the air passage may be regulated by the user. Therefore, an amount of atomization and a smoking taste may be regulated by the user. As another example, air from the outside may flow into the aerosol generating article 2 through at least one hole formed on a surface of the aerosol generating article 2.

Hereinafter, the aerosol generating article 2 will be described in detail with reference to FIG. 4.

Figure 4:
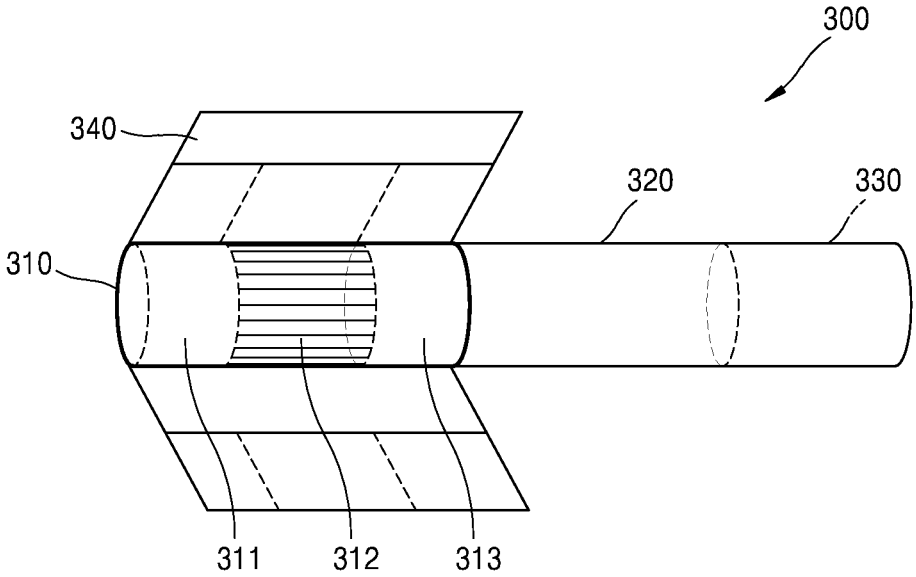
FIG. 4 is a diagram illustrating a configuration of an aerosol generating article, according to an embodiment.

FIG. 4 is a diagram illustrating a configuration of an aerosol generating article, according to an embodiment.

Referring to FIG. 4, an aerosol generating article 300 includes a first segment 310, a second segment 330, a third segment 320, and a wrapper 340. The first segment 310 may include a medium portion 312, a first filter portion 311, and a second filter portion 313.

The aerosol generating article 300 may include an upstream end portion to be inserted into an aerosol generating device and a downstream end portion to contact a user's mouth. The first segment 310 may be arranged at the upstream end portion of the aerosol generating article 300.

The first segment 310 may include the medium portion 312, the first filter portion 311 arranged to face an upstream end portion of the medium portion 312, and the second filter portion 313 arranged to face a downstream end portion of the medium portion 312. The first filter portion 311, the medium portion 312, and the second filter portion 313 may be arranged in a row, and the first filter portion 311 and the second filter portion 313 may be formed in a structure in which the first filter portion 311 and the second filter portion 313 seal the medium portion 312 on both sides of the medium portion 312. By doing so, the medium portion 312 may be prevented from falling off, and the medium portion 312 may be evenly distributed so that an amount of nicotine transfer may be uniform.

The medium portion 312 of the first segment 310 may include an aerosol generating substrate (i.e., aerosol generating material). For example, the aerosol generating substrate may include at least one of glycerin, propylene glycol, ethylene glycol, dipropylene glycol, diethylene glycol, triethylene glycol, tetraethylene glycol, and oleyl alcohol, but is not limited thereto. The aerosol generating substrate may include nicotine.

The medium portion 312 may also contain other additives such as flavoring agents, wetting agents, and/or organic acids. The wetting agents maintain the moisture in granules at an appropriate level to soften the inherent taste and enrich the amount of atomization. The flavoring agents may include licorice, sucrose, fructose syrup, isosweet, cocoa, lavender, cinnamon, cardamom, celery, fenugreek, cascarilla, sandalwood, bergamot, geranium, honey essence, rose oil, Vanilla, lemon oil, orange oil, mint oil, cinnamon, caraway, cognac, jasmine, chamomile, menthol, cinnamon, ylang-ylang, sage, spearmint, ginger, cilantro, coffee, or the like.

The medium portion 312 may include a pH adjuster. The pH adjuster may include at least one of potassium carbonate ($K_2CO_3$), sodium hydrogen carbonate ($NaHCO_3$), and a mixture thereof. The pH adjuster may adjust the pH of the aerosol generating substrate to the alkali side, thereby promoting the release of flavor components from the aerosol generating substrate. Thus, the smoking taste when the aerosol generating article is heated at a low temperature may be equal or similar to that when the aerosol generating article is heated at a high temperature.

According to an embodiment, $K_2CO_3$ may be added to the aerosol generating substrate when granules of the medium portion 312 are manufactured. When manufacturing the granules, a percentage of a content of the $K_2CO_3$ in the aerosol generating substrate may be 5% to 10%. It is desirable that the content of the $K_2CO_3$ relative to the content of the aerosol generating substrate be 6.5%, but is not limited thereto.

The medium portion 312 may further include a binder. By including the binder, the medium portion 312 may be formed into granules. For example, the binder may include at least one of hydroxypropyl methylcellulose (hereinafter referred to as HPMC), gum, pullulan, carboxymethyl cellulose, and starch.

According to an embodiment, the medium portion 312 may be formed of granules. The granules may be formed by drying a mixture of the aerosol generating substrate, the binder, and the pH adjuster dissolved in a liquid state. The medium portion formed of granules may contain 5.9% moisture and 5.41% nicotine, and the pH may correspond to 8.

Content of the medium portion 312 of the aerosol generating article 300 may be appropriately employed from within a range of 70 mg to 120 mg. The content of the medium portion 312 formed of granules of the aerosol generating article 300 may be 100 mg, but is not limited thereto.

When a heating temperature of the medium portion 312 is too low, an amount of nicotine transfer may not be adequate. However, since the medium portion 312 according to an embodiment includes the pH adjuster, an adequate amount of nicotine transfer may be provided even at a low temperature. Accordingly, even when the medium portion 312 is heated at 120° C. or lower, for example at 100° C., an adequate amount of nicotine transfer may be provided.

When the aerosol generating article 300 is inserted into an aerosol generating device, the medium portion 312 may be heated by a heater surrounding the medium portion 312. Since the medium portion 312 may provide an adequate amount of nicotine transfer even when heated at a low temperature, the heater may heat the medium portion 312 at a low temperature, and power consumption of the aerosol generating device may be reduced, accordingly. For example, the medium portion 312 may be heated at 100° C. by the cylindrical heater surrounding the medium portion 312.

According to an embodiment, the medium portion 312 may be heated at 120° C. or lower, and an aerosol containing 20 μg or more of nicotine per puff may be discharged. For example, the medium portion 312 may be heated at 100° C. and discharge an aerosol containing 28 μg of nicotine per puff, but is not limited thereto.

According to an embodiment, the aerosol generating substrate of the medium portion 312 may include nicotine, and a percentage of a weight of nicotine contained in an aerosol discharged from the medium portion 312 after the medium portion 312 is heated relative to a weight of nicotine in the medium portion 312 before the medium portion 312 is heated may be 10% to 30%. For example, assuming that the weight of nicotine in the medium portion 312 before the medium portion 312 is heated is 4.14 mg, and the weight of nicotine contained in 15 puffs of aerosol discharged from the medium portion 312 after the medium portion 312 is heated is 0.7 mg, the percentage of the weight of nicotine contained in the aerosol relative to the weight of nicotine in the medium portion 312 is 17%.

According to an embodiment, when the medium portion 312 of the aerosol generating article 300 is heated at a temperature of 120° C. or lower, an aerosol containing 20 μg to 40 μg of nicotine per puff may be discharged during at least 10 consecutive puffs. Even if the medium portion 312 of the aerosol generating article 300 is heated at a low temperature, a uniform and adequate amount of nicotine may be discharged during at least 10 consecutive puffs.

A length of the medium portion 312 may be appropriately employed in a range of 5 mm to 10 mm Preferably, the length of the medium portion 312 be 8 mm, but is not limited thereto.

The first filter portion 311 may be arranged to face the upstream end portion of the medium portion 312, and the second filter portion 313 may be arranged to face the downstream end portion of the medium portion 312. The first filter portion 311 and the second filter portion 313 may be cellulose acetate filters.

There is no limitation on shapes of the first filter portion 311 and of the second filter portion 313. For example, the first filter portion 311 and the second filter portion 313 may have a cylindrical shape or a tube shape including a hollow therein. Alternatively, the first filter portion 311 and the second filter portion 313 may have a recess shape. The first filter portion 311 and the second filter portion 313 may be manufactured in shapes different from each other.

The first filter portion 311 and the second filter portion 313 may be manufactured to generate flavor. For example, a flavoring liquid may be sprayed onto the first filter portion 311, or a separate fiber coated with the flavoring liquid may be inserted into the first filter portion 311.

The first filter portion 311 and the second filter portion 313 may be arranged on both sides of the medium portion 312 to prevent the medium portion 312 from falling off and to prevent the liquefied aerosol from flowing into the aerosol generating device 1 of FIGS. 1 to 3 from the medium portion 312, during smoking.

According to an embodiment, lengths of the first filter portion 311 and the second filter portion 313 may be within a range of 5 mm to 10 mm, respectively. It is desirable that the lengths of the first filter portion 311 and the second filter portion 313 be each 7 mm. However, embodiments of the present disclosure are not limited thereto.

According to an embodiment, the first filter portion 311, the medium portion 312, and the second filter portion 313 of the first segment 310 may be wrapped by the wrapper 340. Since the first segment 310 is wrapped by the wrapper 340, it is possible to prevent the medium portion 312 from falling off and to prevent the aerosol liquefied from the medium portion 312 from sticking to the aerosol generating device 1 of FIGS. 1 to 3, during smoking.

The third segment 320 may be arranged between the first segment 310 and the second segment 330, and may include a cooling element to cool the aerosol. A length of the third segment 320 may be appropriately employed in a range of 10 mm and 20 mm. For example, the length of the third segment 320 may be about 12 mm, but is not limited thereto.

The third segment 320 cools the aerosol generated by heating the medium portion 312. Thus, the user may inhale the aerosol cooled to an appropriate temperature.

According to an embodiment, the third segment 320 may be made of a polymer material or a biodegradable polymer material. Here, the polymer material includes gelatin, polyethylene (PE), polypropylene (PP), polyurethane (PU), fluorinated ethylene propylene (FEP), and combinations thereof, but is not limited to. In addition, the biodegradable polymer material includes polylactic acid (PLA), polyhydroxy-butyrate (PHB), cellulose acetate, polyepsilon-caprolactone (PCL), polyglycolic acid (PGA), polyhydroxyalkanoates (PHAs) and starch-based thermoplastic resins, but is not limited thereto.

According to an embodiment, the third segment 320 may be made of pure PLA, and may be manufactured in an extrusion method or a fiber weaving method. The third segment 320 may be manufactured in various shapes in order to increase a surface area per unit area (surface area in contact with the aerosol). For example, the third segment 320 may have a shape of a three-dimensional structure manufactured using one or more fiber strands (hereinafter, referred to as 'fiber strands') made of pure PLA. Here, a thickness and length of the fiber strands, the number of the fiber strands constituting the third segment 320, and a shape of the fiber strands may vary. As the third segment 320 is made of pure PLA, generation of a specific material may be prevented while the aerosol passes through the third segment 320.

The second segment 330 may be arranged at a downstream end portion that contacts the user's mouth, and may include a filter element. A length of the second segment 330 may be appropriately employed in a range of 10 mm and 20 mm. For example, the length of the second segment 330 may be about 14 mm, but is not limited thereto.

The second segment 330 may be a cellulose acetate filter. There is no limitation on a shape of the second segment 330. For example, the second segment 330 may have a cylinder shape or a tube shape including a hollow therein. Alternatively, the second segment 330 may have a recess shape. If the second segment 330 includes a plurality of segments, at least one of the plurality of segments may be manufactured in a different shape.

The second segment 330 may be manufactured to generate flavor by spraying a flavoring liquid onto the second segment 330 in the process of manufacturing the same. Alternatively, a separate fiber coated with the flavoring liquid may be inserted into the second segment 330. The aerosol generated from the medium portion 312 is cooled while passing through the third segment 320, and the cooled aerosol is delivered to the user through the second segment 330. Therefore, if a flavoring element is added to the second segment 330, the flavor delivered to the user may last for a long time.

In addition, the second segment 330 may include at least one capsule. Here, the capsule may serve to generate flavor or an aerosol. For example, the capsule may have a structure in which a liquid containing perfume is wrapped with a film. The capsule may have a spherical or cylindrical shape, but is not limited thereto.

According to an embodiment, the aerosol generating article 300 may be packaged by another wrapper. For example, the first segment 310 may be wrapped by the wrapper 340, and the first segment 310, the third segment 320 and the second segment 330 packaged by the wrapper 340 are combined to each other, and the entire segments may be completely repackaged by another wrapper. However, manners in which the aerosol generating article 300 and components constituting the same are packaged by a wrapper are not limited thereto.

Table 1 shows components of the granules of the medium portion 312, according to an experimental example. The medium portion 312 including selected granules having a size of 1.0 mm to 1.12 mm was manufactured. That is, the medium portion 312 including granules having a size of 16 Mesh to 18 Mesh was manufactured.

TABLE 1

| No. | Raw material names | Weights (g) |
|---|---|---|
| 1 | KF125 | 100 |
| 2 | 10% HPMC liquid | 10 |
| 3 | $K_2CO_3$ (food additive) | 6.5 |
| 4 | Purified water | 18.4 |
| 5 | Ethanol | 36.6 |
| 6 | Manufacturing methods | Wet |

It may be identified that according to Table 1, the granules may be manufactured in a wet manner using 100 g of KF125, 10 g of 10% HPMC liquid, 6.5 g of $K_2CO_3$, 18.4 g of purified water, and 36.6 g of ethanol. KF125 may be the aerosol generating substrate, HPMC may be the binder, and $K_2CO_3$ may be the pH adjuster.

In addition, the granules prepared according to Table 1 may be dried for about 6 hours, a moisture content of the dried granules may be 5.9%, nicotine content may be 5.41%, and the pH may be 7.98.

Table 2 below shows nicotine content in the aerosol corresponding to 15 puffs, according to an experimental example. According to one experimental example, a granule content of the medium portion 312 is about 80 mg. The aerosol generating article 300 having a moisture content of 7.05% of the granules of the medium portion 312, nicotine content of 4.14 mg of the medium portion 312, and the pH of 7.5 was used. The aerosol generating article 300 was preheated for 10 seconds and then heated at 100° C. Table 2 shows an amount of nicotine generated from 15 puffs.

TABLE 2

| Divisions | Puff No. | Granule weights (mg) | Nicotine (μg) | Average (μg) | Nicotine (%) | Average (%) |
|---|---|---|---|---|---|---|
| Aerosol | 15 | 81.3 | 509.0 | 478.9 | 0.63 | 0.59 |
| | 15 | 81.4 | 548.7 | | 0.67 | |
| | 15 | 80.9 | 378.9 | | 0.47 | |
| Granules (residues) | 15 | — | 3033.2 | 3008.0 | 3.73 | 3.70 |
| | 15 | — | 2977.4 | | 3.66 | |
| | 15 | — | 3013.3 | | 3.72 | |
| Materials (residues) | 15 | — | 683.6 | 658.2 | 0.84 | 0.81 |
| | 15 | — | 658.8 | | 0.81 | |
| | 15 | — | 632.1 | | 0.78 | |
| Total sums | | | | 4145.0 | | 5.10 |

According to Table 2, in the experiment where a granule weight of the medium portion 312 is 81.3 mg, after 15 puffs, an amount of nicotine in the generated aerosol is 509 μg, an amount of nicotine remaining in the granules is 3033.2 μg, and an amount of nicotine remaining in the first filter portion 311, the second filter portion 313, the third segment 320, and the second segment 330 is 683.6 μg.

In the experiment where a weight of the granules of the medium portion 312 is 81.4 mg, after 15 puffs, an amount of nicotine in the generated aerosol is 548.7 μg, an amount of nicotine remaining in the granules is 2977.4 μg, and an amount of nicotine remaining in the first filter portion 311, the second filter portion 313, the third segment 320, and the second segment 330 is 658.8 μg.

In the experiment where a granule weight of the medium portion 312 is 80.9 mg, after 15 puffs, an amount of nicotine in the generated aerosol is 378.9 μg, an amount of nicotine remaining in the granules is 3013.3 μg, and an amount of nicotine remaining in the first filter portion 311, the second filter portion 313, the third segment 320, and the second segment 330 is 632.1 μg. Moreover, even when the aerosol generating article 300 under the same conditions was heated at 120° C. or lower, results similar to those of Table 2 were obtained.

When the aerosol generating article 300 was heated at a low temperature of 100° C., average nicotine content in the aerosol discharged from the medium portion 312 was 478.9 μg, which indicates that an amount of nicotine transfer was adequate. In addition, it may be identified that nicotine content in the aerosol discharged from the medium portion 312 relative to nicotine content of the aerosol generating substrate before a puff is 12%. Thus, it is desirable to set the nicotine content in the aerosol discharged from the medium portion 312 relative to the nicotine content of the aerosol generating substrate to 10% to 30%.

Table 3 below shows nicotine content in the aerosol according to the number of puffs. In this experimental example, the aerosol generating article 300 having a granule content of about 80 mg of the medium portion 312, a moisture content of 7.05% of the granules before a puff, nicotine content of 4.14 mg, and the pH of 7.5 was used. The aerosol generating article 300 was preheated for 10 seconds and then heated at 100° C. Table 3 shows an amount of nicotine generated per puff. Since an operation of the aerosol generating device was suspended after the 14th puff, nicotine was not detected during the 15th puff.

TABLE 3

| | Puff sections | Puff No. | Nicotine (μg) | Nicotine (mg) |
|---|---|---|---|---|
| Aerosol | 1 | 1 | 27.1 | 0.027 |
| | 2 | 1 | 23.5 | 0.024 |
| | 3 | 1 | 28.0 | 0.028 |
| | 4 | 1 | 28.0 | 0.028 |
| | 5 | 1 | 31.0 | 0.031 |
| | 6 | 1 | 30.6 | 0.031 |
| | 7 | 1 | 36.0 | 0.036 |
| | 8 | 1 | 32.9 | 0.033 |
| | 9 | 1 | 28.8 | 0.029 |
| | 10 | 1 | 26.2 | 0.026 |
| | 11 | 1 | 27.3 | 0.027 |
| | 12 | 1 | 24.4 | 0.024 |
| | 13 | 1 | 22.9 | 0.023 |
| | 14 | 1 | 24.7 | 0.025 |
| | 15 | 1 | | |
| granules (residues) | | | 1468.3 | 1.47 |
| | | | 1476.2 | 1.48 |
| materials (residues) | | | 320.9 | 0.32 |
| | | | 307.1 | 0.31 |

It may be identified that according to Table 3, an amount of nicotine in the aerosol of the first puff is 27.1 μg, an amount of nicotine in the aerosol of the fifth puff in 5 consecutive puffs is 31.0 μg, and an amount of nicotine in the aerosol of the tenth puff in 10 consecutive puffs is 26.2 μg. It may be identified that an amount of nicotine in the aerosol of the 11th puff is similar to an amount of nicotine in the aerosol of the 12th puff, which are 27.3 μg and 24.4 μg, respectively.

As shown above, an amount of nicotine in the aerosol during consecutive puffs is in the range of 20 μg to 40 μg. Thus, it can be seen that an amount of nicotine transfer was uniform even if the aerosol generating article 300 was heated at a low temperature (120° C. or lower).

Table 4 shows an amount of the aerosol collected by a filter within the aerosol generating article 300, according to an experimental example. A total particulate matter (TPM) may refer to an amount of components collected by the filter during puffing. Table 4 shows a total amount of aerosols collected by the filter after 8 puffs. In this experiment, a cylindrical heater was used, and the aerosol generating article 300 was heated at 100° C., 110° C., 120° C., 130° C., 140° C., 150° C., and 160° C.

TABLE 4

| Heating temperatures (° C.) | Before smoking (mg) | After smoking (mg) | TPM (mg) |
|---|---|---|---|
| 100 | 40.0492 | 40.0807 | 0.0315 |
| 110 | 39.9842 | 40.0153 | 0.0311 |
| 120 | 40.1740 | 40.2061 | 0.0321 |
| 130 | 39.6121 | 39.6433 | 0.0312 |
| 140 | 40.0003 | 40.0289 | 0.0286 |
| 150 | 40.1389 | 40.1661 | 0.0272 |
| 160 | 40.1375 | 40.1688 | 0.0313 |

It may be identified that according to Table 4, when a heating temperature was 100° C., 110° C. and 120° C., the TPM was 0.0315 mg, 0.0311 mg, and 0.0321 mg, respectively. When the heating temperature was 140° C. and 150° C., the filter started to be deformed, and thus, the TPM rapidly decreased to 0.0286 mg and 0.0272 mg. At 160° C., the filter contracted due to severe deformation, and thus the TPM increased again to 0.0313 mg.

It may be identified that when a heating temperature was 100° C., 110° C., and 120° C., the filter was not damaged or deformed, so the function was executed smoothly. Therefore, it is desirable to set the heating temperature of the aerosol generating article 300 to 120° C. or lower.

Figure 5:
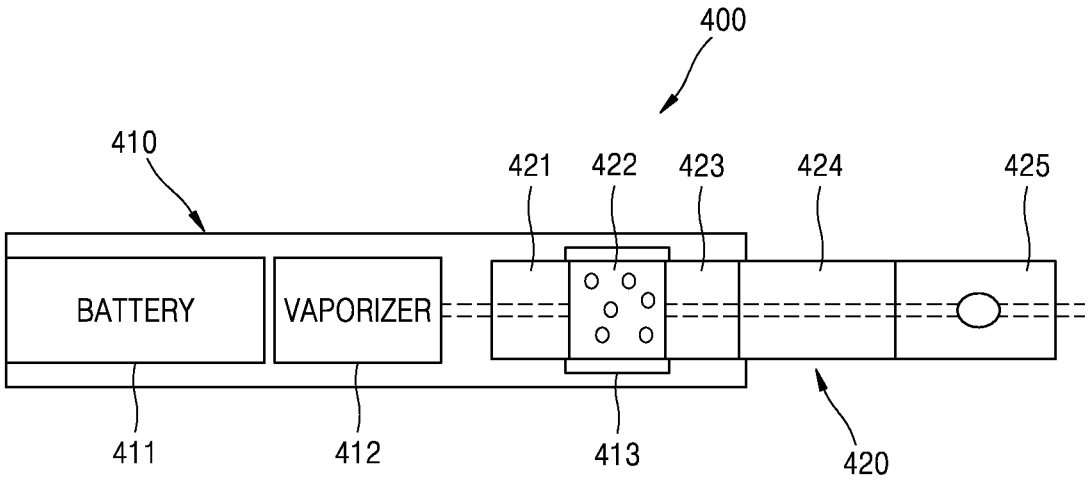
FIG. 5 is a diagram illustrating an aerosol generating device and an aerosol generating article, according to an embodiment.

FIG. 5 is a diagram illustrating an aerosol generating device and an aerosol generating article, according to an embodiment.

Referring to FIG. 5, an aerosol generating system 400 may include an aerosol generating device 410 and an aerosol generating article 420. The aerosol generating system 400, the aerosol generating device 410, a battery 411, and a heater 413 of FIG. 5 may respectively correspond to the aerosol generating system 100, the aerosol generating device 1, the battery 11, and the heater 13 of FIGS. 1 to 3. Also, a vaporizer 412 of FIG. 5 may correspond to the vaporizer 14 of FIGS. 2 to 3. Also, and the aerosol generating article 420, a first filter portion 421, a medium portion 422, a second filter portion 423, a third segment 424, and a second segment 425 of FIG. 5 may respectively correspond to the aerosol generating article 300, the first filter portion 311, the medium portion 312, the second filter portion 313, the third segment 320, and the second segment 330 of FIG. 4. Therefore, redundant descriptions thereof will be omitted herein.

The aerosol generating article 420 may include an upstream end portion to be inserted into the aerosol generating device 410 and a downstream end portion that contacts a user's mouth. The aerosol generating article 420 may include the first segment 421, 422, and 423 arranged at the upstream end portion, the second segment 425 arranged at the downstream end portion, and the third segment 424 arranged between the first segment 421, 422, and 423 and the second segment 425. The first segment 421, 422, and 423 may include the medium portion 422, the first filter portion 421 arranged to face an upstream end portion of the medium portion 422, and the second filter portion 423 arranged to face a downstream end portion of the medium portion 422.

The aerosol generating device 410 may include the battery 411, the vaporizer 412, and the heater 413 heated by power supplied from the battery 411.

According to an embodiment, when the aerosol generating article 420 is inserted into the aerosol generating device 410, the heater 413 may be arranged to surround at least a portion of an outer surface of the medium portion 422 of the aerosol generating article 420. For example, the heater 413 may be arranged only in the medium portion 422 of the aerosol generating article 420. However, embodiments of the present disclosure are not limited thereto.

By arranging the heater 413 near the medium portion 422 of the aerosol generating article 420, the medium portion 422 may be heated to generate an adequate amount of nicotine, heat transfer efficiency to the medium portion 422 may be increased, and power consumption may be reduced. In addition, the first filter portion 421 and the second filter portion 423 may be prevented from being deformed at a high temperature.

The first segment 421, 422, and 423 may be completely inserted into the aerosol generating device 410, and the third segment 424 and the second segment 425 may be exposed to the outside. Alternatively, the entire first segment 421, 422, and 423 and a portion of the third segment 424 may be inserted into the aerosol generating device 410.

At least one of the components, elements, modules or units (collectively "components" in this paragraph) represented by a block in the drawings, such as the controller 12, may be embodied as various numbers of hardware, software and/or firmware structures that execute respective functions described above, according to an exemplary embodiment. For example, at least one of these components may use a direct circuit structure, such as a memory, a processor, a logic circuit, a look-up table, etc. that may execute the respective functions through controls of one or more microprocessors or other control apparatuses. Also, at least one of these components may be specifically embodied by a module, a program, or a part of code, which contains one or more executable instructions for performing specified logic functions, and executed by one or more microprocessors or other control apparatuses. Further, at least one of these components may include or may be implemented by a processor such as a central processing unit (CPU) that performs the respective functions, a microprocessor, or the like. Two or more of these components may be combined into one single component which performs all operations or functions of the combined two or more components. Also, at least part of functions of at least one of these components may be performed by another of these components. Further, although a bus is not illustrated in the above block diagrams, communication between the components may be performed through the bus. Functional aspects of the above exemplary embodiments may be implemented in algorithms that execute on one or more processors. Furthermore, the components represented by a block or processing steps may employ any number of related art techniques for electronics configuration, signal processing and/or control, data processing and the like.

The descriptions of the above-described embodiments are merely examples, and it will be understood by one of ordinary skill in the art that various changes and equivalents thereof may be made. Therefore, the scope of the disclosure should be defined by the appended claims, and all differences within the scope equivalent to those described in the claims will be construed as being included in the scope of protection defined by the claims.

The invention claimed is:

1. An aerosol generating article comprising:

a first segment arranged at an upstream end portion to be inserted into an aerosol generating device;

a second segment arranged at a downstream end portion to contact a user's mouth; and a third segment arranged between the first segment and the second segment, and comprising a cooling element, wherein the first segment comprises:

a first filter portion;

a second filter portion; and a medium portion arranged between the first filter portion and the second filter portion, and comprising an aerosol generating substrate and a pH adjuster, wherein the first segment comprises a configuration in which an outer surface of the medium portion is shaped to be enclosed by a cylindrical heater when engaged with an aerosol generating device, and wherein the medium portion of the first segment is configured to, when heated at 120° C. or lower, discharge an aerosol containing 20 μg or more of nicotine, per puff, wherein lengths of the first filter portion, the medium portion, and the second filter portion are in a range of 5 mm to 10 mm, and wherein lengths of the second segment and the third segment are in a range of 10 mm to 20 mm.

2. The aerosol generating article of claim 1, wherein the first filter portion, the medium portion, and the second filter portion are wrapped by a single wrapper.

3. The aerosol generating article of claim 1, wherein the pH adjuster comprises potassium carbonate ($K_2CO_3$).

4. The aerosol generating article of claim 1, wherein the medium portion further comprises a binder, and the binder comprises at least one of hydroxypropyl methylcellulose and gum.

5. The aerosol generating article of claim 1, wherein a weight of the medium portion is in a range of 70 mg to 120 mg.

6. The aerosol generating article of claim 1, wherein the aerosol generating substrate of the medium portion comprises nicotine, and a weight of nicotine contained in the aerosol discharged from the medium portion after the medium portion is heated is 10% to 30% of a weight of nicotine in the medium portion before the medium portion is heated.

7. The aerosol generating article of claim 1, wherein, when the medium portion is heated at 120° C. or lower, the aerosol containing 20 μg to 40 μg of nicotine per puff is discharged during at least 10 consecutive puffs.

8. An aerosol generating system comprising:

an aerosol generating article; and an aerosol generating device configured to combine with the aerosol generating article, and comprising a heater configured to heat the aerosol generating article, wherein the aerosol generating article comprises:

a first segment arranged at an upstream end portion to be inserted into the aerosol generating device;

a second segment arranged at a downstream end portion to contact a user's mouth; and a third segment arranged between the first segment and the second segment, and comprising a cooling element, wherein the first segment comprises:

a first filter portion;

a second filter portion; and a medium portion arranged between the first filter portion and the second filter portion, comprising an aerosol generating substrate and a pH adjuster such that an aerosol containing 20 μg or more of nicotine is discharged per puff when the medium portion is heated at a temperature of 120° C. or lower, wherein the first segment is disposed so that an outer surface of the medium portion of the first segment is surrounded by a cylindrical heater when the first segment is inserted into the aerosol generating device, wherein the medium portion of the first segment is heated at 120° C. or lower by the cylindrical heater of the aerosol generating device, and the medium portion of the first segment discharges an aerosol containing 20 μg or more of nicotine, per puff, wherein lengths of the first filter portion, the medium portion, and the second filter portion are in a range of 5 mm to 10 mm, and wherein lengths of the second segment and the third segment are in a range of 10 mm to 20 mm.

9. The aerosol generating system of claim 8, wherein the heater is arranged to surround at least a portion of an outer surface of the medium portion when the aerosol generating article is inserted into the aerosol generating device.

* * * * *